US010358609B2

(12) United States Patent
Grande et al.

(10) Patent No.: US 10,358,609 B2
(45) Date of Patent: Jul. 23, 2019

(54) PROCESS FOR REMOVING METAL NAPHTHENATE FROM CRUDE HYDROCARBON MIXTURES

(71) Applicant: STATOIL PETROLEUM AS, Stavanger (NO)

(72) Inventors: Knut Grande, Stavanger (NO); Hege Kummernes, Stavanger (NO); Kim Reidar Høvik, Stavanger (NO); Jens Emil Vindstad, Stavanger (NO); Heidi Mediaas, Stavanger (NO); Jorunn Steinsland Rosvoll, Stavanger (NO); Ingvild Johanne Haug, Stavanger (NO)

(73) Assignee: STATOIL PETROLEUM AS, Stavanger (NO)

( * ) Notice: Subject to any disclaimer, the term of this patent is extended or adjusted under 35 U.S.C. 154(b) by 0 days.

(21) Appl. No.: 15/538,861

(22) PCT Filed: Dec. 23, 2014

(86) PCT No.: PCT/EP2014/079147
§ 371 (c)(1),
(2) Date: Jun. 22, 2017

(87) PCT Pub. No.: WO2016/101998
PCT Pub. Date: Jun. 30, 2016

(65) Prior Publication Data

US 2017/0349841 A1 Dec. 7, 2017

(51) Int. Cl.
*E21B 43/34* (2006.01)
*E21B 43/40* (2006.01)
(Continued)

(52) U.S. Cl.
CPC ..... *C10G 53/10* (2013.01); *C10G 17/04* (2013.01); *C10G 31/08* (2013.01); *E21B 43/40* (2013.01);
(Continued)

(58) Field of Classification Search
CPC ..... E21B 43/34; E21B 43/40; C10G 17/02; C10G 17/04; C10G 17/06; C10G 17/07; C10G 19/00
See application file for complete search history.

(56) References Cited

U.S. PATENT DOCUMENTS 2,003,640 A * 6/1935 Wunsch ..... C07C 51/48 562/511
4,988,433 A 1/1991 Reynolds et al.
(Continued)

FOREIGN PATENT DOCUMENTS

CN 1120575 A 4/1996
CN 1657594 A 8/2005
(Continued)

OTHER PUBLICATIONS

International Search Report for PCT/EP2014/079147 (PCT/ISA/210) dated Sep. 10, 2015.
(Continued)

*Primary Examiner* — Catherine Loikith
(74) *Attorney, Agent, or Firm* — Birch, Stewart, Kolasch & Birch, LLP

(57) ABSTRACT

Metal naphthenate is removed from a crude hydrocarbon mixture by a process. The process includes mixing the crude hydrocarbon mixture comprising metal naphthenate with an acid in the presence of water, wherein the acid converts the metal naphthenate to naphthenic acid and metal salt; allowing the metal salt to partition into a water phase; and separating the crude heavy hydrocarbon mixture comprising
(Continued)

naphthenic acid and the water phase comprising the metal salt.

22 Claims, 3 Drawing Sheets

(51) Int. Cl.
*C10G 17/04* (2006.01)
*C10G 53/10* (2006.01)
*C10G 31/08* (2006.01)

(52) U.S. Cl.
CPC . *C10G 2300/205* (2013.01); *C10G 2300/308* (2013.01)

(56) References Cited

U.S. PATENT DOCUMENTS

| | | | |
|---|---|---|---|
| 6,905,593 | B2 | 6/2005 | Kuehne et al. |
| 7,399,403 | B2 | 7/2008 | Garcia, III et al. |
| 7,497,943 | B2 | 3/2009 | Nguyen et al. |
| 8,366,915 | B2 | 2/2013 | Goliaszewski et al. |
| 8,372,270 | B2 | 2/2013 | Nguyen et al. |
| 8,372,271 | B2 | 2/2013 | Nguyen et al. |
| 2004/0045875 | A1 | 3/2004 | Nguyen et al. |
| 2007/0125685 | A1 | 6/2007 | Goliaszewski et al. |
| 2010/0163457 | A1 | 7/2010 | Subramaniyam |
| 2011/0068049 | A1 | 3/2011 | Garcia, III et al. |
| 2011/0120913 | A1 | 5/2011 | Snawerdt |
| 2012/0285865 | A1 | 11/2012 | Subramaniyam |
| 2013/0193374 | A1 | 8/2013 | Subramaniyam |
| 2013/0213857 | A1 | 8/2013 | Bisht et al. |

FOREIGN PATENT DOCUMENTS

| | | | |
|---|---|---|---|
| CN | 101457155 | A | 6/2009 |
| CN | 101457156 | A | 6/2009 |
| CN | 102337150 | A | 2/2012 |
| CN | 103045292 | A | 4/2013 |
| CN | 103045299 | A | 4/2013 |
| WO | WO 98/14402 | A1 | 4/1998 |
| WO | WO 2013/024489 | A1 | 2/2013 |

OTHER PUBLICATIONS

Written Opinion of the International Searching Authority for PCT/EP2014/079147 (PCT/ISA/237) dated Sep. 10, 2015.
"A new process for removing calcium from crude oils containing calcium naphthenates", presentation by Scott Bieber, Baker Hughes, May 26, 2005.
"Chloroacetic acid", Organisation for Economic Co-operation and Development, Screening information data set (OECD SIDS).
"Citric acid", Organisation for Economic Co-operation and Development, Screening information data set (OECD SIDS), initial assessment report for SIAM 11, 2001.
"EC2483A Resolve® Metals removal product" brochure, Nalco Champion, 2013.
"Gluconic acids and its derivatives", Organisation for Economic Co-operation and Development, Screening information data set (OECD SIDS), initial assessment report for SIAM 18, 2004.
"GPS product safety summary—document No. GPSSR-125", Clairant, 2013.
"How pH management improves desalter operations", Baker Hughes Inc, Oct. 2012.
"Resolv® Containment removal program effectively removes calcium and maintains unit reliability at a UK refiner", brochure, Nalco Champion, 2013.
"Resolve® Contaminant Removal Program effectively increases Opportunity Crude Processing at a Latin American Refinery", brochure, Nalco Champion, 2013.
"Resolv® Contaminant removal program increases calcium removal rates, eliminates costly downstream impacts, improves reliability and saves refiner > $15M in TCO" brochure, Nalco Champion, 2013.
"Simple bi-functional molecule for multiple requirements," Clariant, 2013.
"Thioglycolic acids and its ammonium salts", Organisation for Economic Co-operation and Development, Screening information data set (OECD SIDS), initial assessment report for SIAM 28, Apr. 2009.
Alan Goliaszewski, "GE Water & Process Technologies", 2006 NPRA Q&A and technology forum: Answer book, Phoenix, Arizona, Oct. 8-11, 2006.
Emma McAra et al., "Calcium in crude investigation", Clairant oil services, Dec. 2006.
James Sangster, "Octanol-water partition coefficients of simple organic compounds", J. Phys. Chem. Ref. Data. vol. 18, No. 3, pp. 1111-1226, 1989.
Jerry J. Weers and Scott Bieber, "Calcium removal from high TAN crudes", PTQ, vol. 10, No. 4, 2005.
Parag Shah et al., "Novel additives to Improve Resid Quality", AIChE Paper Number, Presentation at the 2011 Spring National Meeting, Chicago, IL, Mar. 15, 2011.
Rasrendra et al., "Recovery of acetic acid from an aqueous pyrolysis oil phase by reactive extraction using tri-n-octylamine", Chem. Eng. J., 176-177, pp. 244-252, 2011.
Reinsel et al., "Partition coefficients for acetic, propionic and butyric acids in a crude oil/water system", J. Chem. Eng. Data, vol. 39, pp. 513-516, 1994.
Sam Lordo, John M Garcia, and Sandra Garcia-Swofford, "Desalter Acidification Additives and Their Potential Impacts on Crude Units", NACE 2008 paper.
Scaletreat, accessed on the Clariant Website: https://www.clariant.com/Solutions/Products/2014/10/30/13/02/SCALETREAT, edition date Sep. 5, 2018.

* cited by examiner

PROCESS FOR REMOVING METAL NAPHTHENATE FROM CRUDE HYDROCARBON MIXTURES

INTRODUCTION

The present invention relates to a process for removing metal naphthenate from a crude hydrocarbon mixture and to a process for hydrocarbon production wherein metal naphthenate is removed from the crude hydrocarbon mixture. The invention also relates to a system for removing metal naphthenate from a crude hydrocarbon mixture and to a crude hydrocarbon mixture per se.

BACKGROUND

Heavy hydrocarbons represent a huge natural source of the world's total potential reserves of oil. Present estimates place the quantity of heavy hydrocarbon reserves at several trillion barrels, more than 5 times the known amount of the conventional, i.e. non-heavy, hydrocarbon reserves. This is partly because heavy hydrocarbons are generally difficult to recover by conventional recovery processes and thus have not been exploited to the same extent as non-heavy hydrocarbons.

Heavy hydrocarbons also present many challenges topside after extraction from a formation. They possess very high viscosities which makes them difficult to pump in their native state. Additionally heavy hydrocarbons are characterised by high levels of unwanted compounds such as asphaltenes, trace metals and sulphur that need to be processed appropriately. Heavy hydrocarbons also contain ARN acids at ppm levels.

Another class of unwanted compound that is present in many hydrocarbons, and particularly in heavy hydrocarbons, is metal naphthenates. They may be present in crude hydrocarbon mixtures in significant amounts. For example, Doba crude oil has been reported to contain more than 400 ppm wt of metal naphthenates.

Metal naphthenates are often formed from naphthenic acids. Two main categories of naphthenic acids exist. These are: (1) naphthenic acids which are monoacids; and (2) ARN naphthenic acids, which are $C_{80-82}$ tetracids. The ARN naphthenic acids are problematic during production because they form water soluble metal naphthenates that are sticky solids which harden on contact with air and cause fouling of pipelines and processing equipment. The present invention is concerned, however, with the naphthenic acids which are monoacids. These are problematic during production because they form oil soluble metal naphthenates which promote formation of stable emulsions.

Naphthenic acids of both categories are present in crude oil, under reservoir conditions, and reside in the hydrocarbon. Naphthenic acids which are monocarboxylic acids may be present in amounts of up to 12% wt. During extraction from a formation, depressurisation of the crude hydrocarbon mixture occurs as it moves up through the production tubing, and ultimately to the surface. This, in turn, causes $CO_2$ present in the hydrocarbon mixture to flash and for the pH of the water present in the crude hydrocarbon mixture to increase. This results in the formation of naphthenate salts with ions from the water, e.g. calcium naphthenate and magnesium naphthenate. Some metal naphthenates may also form in the reservoir. This may occur, for example, if the pH of the water phase in the formation is relatively high, e.g. exceeds a pH of about 6.5 and the water has a relatively high salinity. The ARN naphthenic acids form water soluble metal naphthenates whereas the naphthenic acids which are monoacids form oil soluble metal naphthenates. The metal naphthenates present in a crude hydrocarbon mixture therefore derive from monocarboxylic naphthenic acids in the formation and/or produced from monocarboxylic naphthenic acids during hydrocarbon production from the formation.

Oil soluble metal naphthenates derived from monocarboxylic naphthenic acids are problematic during production of hydrocarbon from the formation because they cause significant problems during separation of crude hydrocarbon mixture from water. They tend to accumulate at the oil/water interface and act as surfactants. More specifically oil soluble metal naphthenates cause challenges including increased conductivity and poorer separation in the coalescer, formation of stable formations, water carryover, poor effluent water quality, scaling, corrosion and poisoning of refinery catalysts. Additionally the quality of fuel and coke derived from residue can, in some instances, be decreased when there are relatively high levels of calcium in the original oil phase.

In current commercially operated processes, the majority of the oil soluble metal naphthenate present in a crude hydrocarbon mixture extracted from a formation remains in the crude hydrocarbon mixture after the bulk separation process. Thus the crude hydrocarbon mixture transported to the refinery often contains significant amounts of oil soluble metal naphthenate and therefore metals such as calcium in the hydrocarbon phase. These must be removed during processing at the refinery in expensive processes. It is, in fact, estimated that the cost of handling the metal ions deriving from oil soluble metal naphthenates at the refinery is around 0.5 to 5 USD/bbl. The processes are also problematic. Problems have been experienced in the waste water treatment plant due to the increased levels of metal salts in the waste water and corrosion of overhead towers due to use of acetic acid to remove calcium naphthenate has been reported. Currently refineries are unable to deal with crude hydrocarbon comprising more than 100 ppm wt metal naphthenate.

SUMMARY OF INVENTION

Viewed from a first aspect the present invention provides a process for removing metal naphthenate from a crude hydrocarbon mixture comprising:

- mixing said crude hydrocarbon mixture comprising metal naphthenate with an acid in the presence of water, wherein said acid converts said metal naphthenate to naphthenic acid and metal salt;
- allowing said metal salt to partition into a water phase;
- separating said crude heavy hydrocarbon mixture comprising naphthenic acid and said water phase comprising said metal salt; and
- preferably pumping said water phase comprising said metal salt into a formation.

Viewed from a further aspect the present invention provides a process for producing hydrocarbon from a hydrocarbon containing formation comprising:

- extracting a crude hydrocarbon mixture from a hydrocarbon containing formation;
- mixing said crude hydrocarbon mixture comprising metal naphthenate with an acid in the presence of water, wherein said acid converts said metal naphthenate to naphthenic acid and metal salt;
- allowing said metal salt to partition into a water phase;

separating said crude hydrocarbon mixture comprising naphthenic acid and said water phase comprising said metal salt;

pumping said crude hydrocarbon mixture comprising naphthenic acid to a refinery; and preferably pumping said water phase comprising said metal salt into a formation.

Viewed from a further aspect the present invention provides a system for removing metal naphthenate from a crude hydrocarbon mixture comprising:

a container comprising an acid;

a line for conveying a crude hydrocarbon mixture to a separator;

a means for adding said acid to said line conveying a crude hydrocarbon mixture to a separator, wherein said means is fluidly connected to said container comprising acid;

a first separator for separating a crude hydrocarbon mixture comprising naphthenic acid and a water phase comprising a metal salt, wherein said separator has an inlet for crude hydrocarbon mixture, an outlet for crude hydrocarbon mixture comprising naphthenic acid and an outlet for an water phase comprising a metal salt; and preferably a line for conveying said water phase comprising a metal salt into a formation.

Viewed from a further aspect the present invention provides a crude hydrocarbon mixture obtainable by the process as hereinbefore defined.

Viewed from a further aspect the present invention provides a crude hydrocarbon mixture obtained by the process as hereinbefore defined.

Viewed from a further aspect the present invention provides a crude hydrocarbon mixture comprising 0.1 to 12 wt % naphthenic acid and less than 100 ppm wt metal ion as metal naphthenate.

Viewed from a further aspect the present invention provides use of an acid to remove metal naphthenate from a crude hydrocarbon mixture, comprising adding said acid to said crude hydrocarbon mixture in the presence of water to form naphthenic acid and metal salt, separating said crude heavy hydrocarbon mixture comprising naphthenic acid and said water phase comprising said metal salt and preferably pumping said water phase comprising said metal salt into a formation.

DEFINITIONS

As used herein the term "naphthenic acid" refers to a mixture of monocarboxylic acids having an average molecular weight of 200 to 2000 g/mol. The term "naphthenic acid" as used herein does not encompass ARN acids.

As used herein the term "metal naphthenate" refers to a monocarboxylate salt formed by naphthenic acid and metal ions. Preferred metal naphthenates described herein are oil soluble.

As used herein the term "hydrocarbon mixture" refers to a combination of different hydrocarbons, i.e. to a combination of various types of molecules that contain carbon atoms and, in many cases, attached hydrogen atoms. A "hydrocarbon mixture" may comprise a large number of different molecules having a wide range of molecular weights. Generally at least 90% by weight of the hydrocarbon mixture consists of carbon and hydrogen atoms. Up to 10% by weight may be present as sulfur, nitrogen and oxygen as well as metals such as iron, nickel and vanadium (i.e. as measured sulfur, nitrogen, oxygen or metals).

As used herein the term "crude hydrocarbon mixture" refers to a hydrocarbon mixture which has been extracted from a formation and prior to upgrading and/or transportation to a refinery. The crude hydrocarbon mixture may be the mixture extracted from the formation, in which case it will also comprise water. Additionally the crude hydrocarbon mixture may be a mixture produced from a separation process, e.g. a phase separation. In preferred processes of the invention both the starting mixture and the final mixture of the process of the present invention is a crude hydrocarbon mixture because the process does not comprise any upgrading.

As used herein the term "heavy hydrocarbon mixture" refers to a hydrocarbon mixture comprising a greater proportion of hydrocarbons having a higher molecular weight than a relatively lighter hydrocarbon mixture. Terms such as "light", "lighter", "heavier" etc. are to be interpreted herein relative to "heavy".

As used herein the term "upgrading" refers to a process wherein the hydrocarbon mixture is altered to have more desirable properties, e.g. to providing lighter, synthetic crude oils from heavy hydrocarbon mixtures by chemical processes including visbreaking.

As used herein the term "diluent" refers to a hydrocarbon having an API of at least 20° and more preferably at least 30°.

As used herein API gravity refers to API as measured according ASTM D287.

As used herein viscosity refers to viscosity in cSt at 15° C. as measured according to ASTM D445 process.

As used herein the term "fluidly connected" encompasses both direct and indirect fluid connections.

As used herein the terms "formation" and "reservoir" are used synonymously and refer to a subterranean porous or fractured rock.

DETAILED DESCRIPTION

In the processes of the present invention a metal naphthenate, preferably an oil soluble metal naphthenate, is removed from a crude hydrocarbon mixture. The process comprises mixing the crude hydrocarbon mixture comprising metal naphthenate with an acid in the presence of water. The proton of the acid contacts the metal naphthenate and converts it to naphthenic acid and metal salt. The naphthenic acid is soluble in the crude hydrocarbon mixture whereas the metal salt is water soluble. The process therefore further comprises allowing the metal salt to partition into a water phase and then separating the crude heavy hydrocarbon mixture comprising naphthenic acid and the water phase comprising the metal salt. Thus advantageously the metal salt present in the metal naphthenate in the crude hydrocarbon mixture is effectively removed into a water phase. In preferred processes of the invention the water phase comprising the metal salt is pumped into a formation and particularly preferably into a hydrocarbon-depleted formation. This is particularly advantageous since it avoids having to treat the water to remove the metal salts for disposal into a waste water system. Moreover since the processes of the present invention are preferably carried out at a well site, e.g. offshore, disposal into a depleted hydrocarbon formation is convenient.

In the processes of the present invention the crude hydrocarbon mixture initially comprises at least 40 ppm wt of metal ion as metal naphthenate. In preferred processes of the invention the crude hydrocarbon mixture initially comprises 50 to 1500 ppm wt of the metal ion as metal naphthenate, more preferably 100 to 1200 ppm wt of the metal ion as metal naphthenate, still more preferably 200 to 1000 ppm wt of the metal ion as metal naphthenate and yet more preferably 300 to 800 ppm wt of the metal ion as metal naphthenate. These metal naphthenate levels are typically present in crude hydrocarbon mixtures extracted from the Doba field in West Africa or the Bressay field in the North Sea.

In the processes of the present invention, the metal naphthenate may be any alkaline earth metal naphthenate. These metal naphthenates are preferably hydrocarbon (i.e. oil) soluble. For example the metal naphthenate may comprise $Mg^{2+}$, $Ca^{2+}$, $Sr^{2+}$, $Ba^{2+}$ or mixtures thereof. Preferably, however, the metal naphthenate comprises $Ca^{2+}$ or $Mg^{2+}$ and still more preferably the metal naphthenate comprises $Ca^{2+}$. Thus, in preferred processes of the invention, the metal naphthenate is calcium naphthenate.

In the processes of the present invention, the metal naphthenate preferably comprises $C_{10-100}$ naphthenates and more preferably $C_{12-60}$ naphthenates. Preferred naphthenates removed by the process of the present invention comprise 4 to 8 $C_{3-8}$ rings, more preferably 5 to 7 $C_{3-8}$ rings and still more preferably 5 or 6 $C_{3-8}$ rings. Preferred rings comprise 4, 5 or 6 carbon atoms. The $C_{3-8}$ rings may be saturated, unsaturated or aromatic. Particularly preferred naphthenates removed by the process of the present invention have a MW of at least 200 g/mol, more preferably 200 to 2000 g/mol, still more preferably 400 to 1200 g/mol and yet more preferably 500 to 800 g/mol.

In preferred processes of the invention the metal naphthenate is removed from a crude heavy hydrocarbon mixture. The crude heavy hydrocarbon mixture preferably has an API gravity of less than about 18°. More preferably the API gravity of the crude heavy hydrocarbon mixture is 10 to 18°, more preferably 12 to 18° and still more preferably 16 to 18°. The viscosity of the crude heavy hydrocarbon mixture is preferably 250 to 10,000 cSt at 15° C., more preferably 400 to 8000 cSt at 15° C. and still more preferably 500 to 5000 cSt at 15° C.

Often heavy hydrocarbon mixtures are recovered at well sites located significant distances away from a refinery. For instance, the heavy hydrocarbon mixture may be recovered offshore. Preferably therefore the processes of the present invention are carried out at a well site. Advantageously the water phase comprising metal salt is returned to a formation, e.g. a hydrocarbon depleted formation, at the well site. Preferably the processes of the present invention are carried out on a crude hydrocarbon mixture which has not been upgraded.

Prior to carrying out the first step of the process of the present invention, the crude hydrocarbon mixture, e.g. recovered from a formation, may be optionally cleaned. Preferably the crude hydrocarbon mixture is cleaned. The crude hydrocarbon mixture may, for example, undergo treatment(s) to remove solids such as sands as well as gas therefrom. Solids, such as sand, may be removed from a crude hydrocarbon mixture by, e.g. hot water extraction, by filtration or by settling processes known in the art. The exact details of the cleaning process will depend on how the crude hydrocarbon mixture has been recovered. The skilled man will readily be able to identify suitable cleaning techniques.

Another optional step that may be carried out prior to the first step of the process of the present invention is the addition of a diluent to the crude hydrocarbon mixture. Thus a preferred process of the invention further comprises adding diluent to the crude hydrocarbon mixture, prior to mixing the crude hydrocarbon mixture with the acid. Diluent addition may be used, for example, to adjust the API of the crude hydrocarbon mixture into a range in which crude hydrocarbon mixture and water can be easily separated. Diluent may, for example, be added to adjust the API of the crude heavy hydrocarbon mixture to about 15-20°. In other processes, however, no diluent is added to the crude hydrocarbon mixture prior to the first step of the process of the present invention.

When diluent addition is carried out, preferably the diluent is a hydrocarbon diluent. Preferred hydrocarbon diluents include naphtha and lighter crude oils. Generally preferred diluents comprise a mixture of $C_{6-60}$ hydrocarbons, particularly $C_{10-42}$ hydrocarbons and more preferably $C_{12+}$ hydrocarbons. Diluents comprising longer hydrocarbons, e.g. $C_{6+}$ or $C_{10+}$ are preferred since they are less likely to cause flashing when they are added to the water. Preferred diluents have an API of 20-80°, more preferably 30-70°.

A key step in the processes of the present invention is the addition of acid to the crude hydrocarbon mixture comprising metal naphthenate. The reaction which occurs when acid contacts metal naphthenate (MNA) is shown below:

MNA (oil)+H+(water)=NAH (oil)+M+(water) (equilibrium reaction)

The naphthenic acid (NAH) produced is soluble in the crude hydrocarbon mixture. The metal ion is water soluble and partitions into the water phase. The net result is the removal of the metal ion from the crude hydrocarbon mixture. The reaction which occurs in the specific case of calcium naphthenate is shown below:

$Ca(NA)_2$ (oil)+2H+(water)=2NAH (oil)$_4$$Ca^{2+}$(water) (equilibrium reaction)

The presence of acid (i.e. $H^+$ ions) drives these reactions towards naphthenic acid (NAH) and metal salt and hence to the removal of metal ions such as $Ca^{2+}$ from the crude hydrocarbon mixture.

The acid used in the process of the invention preferably has a pKa of less than 7, still more preferably a pKa of less than 6 and yet more preferably a pKa of less than 5. The acid may be an inorganic acid or an organic acid. Inorganic acids advantageously do not generate metal salts that are problematic for downstream processing at a refinery. Organic acids advantageously are less corrosive than inorganic acids.

Representative examples of suitable inorganic acids include hydrochloric acid, nitric acid, hydrobromic acid, hydroiodic acid, perchloric acid and phosphoric acid. A preferred inorganic acid is hydrochloric acid.

Preferred organic acids comprise at least one carboxylic acid group, e.g. comprise 1, 2 or 3 carboxylic acid groups. Representative examples of suitable organic acids include acetic acid, formic acid, glycolic acid, gluconic acid, glyoxal (aldehyde), glyoxylic acid, thioglycolic acid, citric acid, lactic acid, trifluoroacetic acid, chloroacetic acid, ascorbic acid, benzoic acid, propionic acid, phthalic acid, fumaric acid, oxalic acid, tartaric acid, maleic acid, succinic acid, malic acid, methanesulfonic acid, benzenesulfonic acid and p-toluenesulfonic acid. Preferred organic acids for use in the processes of the present invention are acetic acid and formic acid. In many circumstances organic acids are preferred to inorganic acids. This is because the inorganic acids generally have a lower pH and can, in some cases, cause corrosion in the system and particularly at the injection point.

In preferred processes of the invention the acid is added in a solution. The concentration of the acid depends on whether the further water is required in the mixture which, in turn, depends on the amount of water present in the crude hydrocarbon mixture. The skilled man will readily be able to determine a suitable concentration. The pH of the acid solution (i.e. at the injection point and prior to contact with a crude hydrocarbon mixture) is less than 7. More preferably the pH of the acid solution is 1 to 6.5, more preferably 2 to 6 and still more preferably 3 to 6.

In preferred processes of the invention the amount of acid mixed with the crude hydrocarbon mixture is present in at least a stoichiometric amount based on the amount of naphthenate ion present in the crude hydrocarbon mixture. Preferably the acid is present in at least an equimolar amount to the naphthenate ion. Thus, in the case of calcium naphthenate removal, in preferred processes of the invention at least two mole equivalents of acid are used per mole of calcium naphthenate. In particularly preferred processes of the invention the stoichiometric molar ratio of acid to metal naphthenate is 2 to 10:1, more preferably 2 to 5:1 and still more preferably 3 to 5:1.

In the processes of the present invention a reaction has to occur between metal naphthenate present in the crude hydrocarbon mixture and acid which is present in water. Typically the water is either extracted from the formation or water added to the hydrocarbon, post extraction, for separation. In preferred processes of the invention, at least 10% by volume of water is present during the reaction of metal naphthenate and acid. More preferably the reaction comprises 10 to 50%, more preferably 15 to 35% and still more preferably 15 to 25% by volume based on the total volume of liquid.

The reaction between the metal naphthenate in the crude hydrocarbon mixture and the acid requires mixing, preferably intimate mixing, of the phases to achieve a high interfacial contact area between the metal naphthenate and the acid. Without being bound by theory, it is thought that the reaction may take place at the interface of the phases or within the crude hydrocarbon mixture following diffusion of the proton from the acid therein. The reaction rate is therefore believed to be dependent on the mixing efficiency of the phases and the interfacial area obtained.

In preferred processes of the invention the mixing is achieved by injecting the acid into a line conveying the crude hydrocarbon mixture. Preferably the line is a production pipeline. More preferably the line is a line conveying crude hydrocarbon mixture from a well arrangement in a formation. Preferably the velocity and shear rate of the crude hydrocarbon mixture in the line is sufficient to achieve effective mixing. Optionally, and preferably, a static mixer may be introduced into the line to improve the mixing of the phases.

Preferably the effect of mixing is to create water droplets comprising the acid. More preferably the droplets have an average diameter of 5 to 200 still more preferably 5 to 150 μm and yet more preferably 5 to 100 Generally droplets having a relatively small average diameter are preferred since this increases the surface area for contact with metal naphthenate. On the other hand, it is important not to generate droplets that are too small otherwise this negatively impacts on the subsequent separation of the crude hydrocarbon mixture and water phases.

In the processes of the present invention, a water and crude hydrocarbon mixture phase separation occurs. As described above, the naphthenic acid produced in the reaction between metal naphthenate and acid is soluble in the crude hydrocarbon mixture whilst the metal salt deriving from the metal naphthenate is water soluble and partitions into the water phase. In preferred processes of the invention the total residence time, which is the combination of the reaction time and the separation time, is 1 to 30 minutes, preferably 5 to 20 minutes and more preferably 5 to 10 minutes.

In some preferred processes of the invention the acid is added to a crude hydrocarbon mixture extracted from a subterranean formation. In such processes the acid is added prior to bulk separation of the crude hydrocarbon mixture comprising crude hydrocarbon mixture and water into crude hydrocarbon mixture and water. In this case, the crude hydrocarbon mixture additionally comprises water. Optionally further water may be added to the mixture. Preferably the mixture which undergoes separation comprises 10 to 50%, more preferably 15 to 35% and still more preferably 15 to 25% by volume water based on the total volume of hydrocarbon and water.

In other preferred processes of the invention the acid is added to a crude hydrocarbon mixture which comprises at least 95% by volume of a crude hydrocarbon mixture. Optionally, e.g. preferably, water is added to the crude hydrocarbon mixture prior to, simultaneously to, or after the addition of acid. Preferably the water is added simultaneously with the acid. Still more preferably an aqueous acid solution is employed. Preferably the mixture which undergoes separation comprises 10 to 30%, more preferably 15 to 25% and still more preferably 15 to 20% by volume water based on the total volume of hydrocarbon and water.

In a particularly preferred process of the invention the acid is added prior to bulk separation and prior to a second separation.

In preferred processes of the invention the crude hydrocarbon mixture obtained after separation comprises less than 100 ppm wt metal ion as metal naphthenate. More preferably the crude hydrocarbon mixture obtained after separation comprises 0 to 100 ppm wt metal ion as metal naphthenate, still more preferably 1 to 80 ppm wt metal ion as metal naphthenate and yet more preferably 10 to 50 ppm wt metal ion as metal naphthenate. The desalters at refineries can handle this level of metal naphthenate without any modification. More preferably the crude hydrocarbon mixture obtained after separation comprises 0.1 to 12 wt % naphthenic acid, still more preferably 1 to 10 wt % naphthenic acid and yet more preferably 2.5 to 10 wt % naphthenic acid. The API of the crude hydrocarbon mixture obtained after separation is preferably 10 to 18°, still more preferably 12 to 18° and yet more preferably 16 to 18°. The viscosity of the crude hydrocarbon mixture obtained after separation is preferably 250 to 10,000 cSt at 15° C., more preferably 400 to 8000 cSt at 15° C. and still more preferably 500 to 5000 cSt at 15° C.

Preferred processes of the invention further comprise upgrading the crude hydrocarbon mixture comprising naphthenic acid. Particularly preferred processes of the invention further comprise treating the crude hydrocarbon mixture comprising naphthenic acid to reduce its API. In preferred processes of the invention the upgrading is carried out by using a solvent extraction process and/or a thermal process (e.g. a thermal cracking process). Alternatively, or additionally, diluent addition may be carried out.

Solvent extraction may be carried out by any conventional procedure known in the art. Preferred solvents for use in solvent extraction include butane and pentane. Whilst solvent extraction removes asphaltenes including naphthenic acid from the hydrocarbon mixture, it does not convert heavy hydrocarbons to lighter hydrocarbons, i.e. no conversion takes place.

Preferred thermal processes include delayed coking, visbreaking, hydrocracking (e.g. ebullated bed or slurry hydrocracking) and hydrotreating (e.g. distillate hydrotreating). Particularly preferably the upgrading is carried out by hydrocracking or delayed coking, especially hydrocracking.

Diluent addition may be carried out by any conventional procedure known in the art. Preferred diluents are those described above.

Preferred processes of the invention are carried out at a wellsite. Thus preferably the metal naphthenate is removed from the crude hydrocarbon mixture before the mixture is pumped to a refinery. Further preferred processes of the invention further comprise pumping the crude hydrocarbon mixture comprising naphthenic acid to a refinery.

The present invention also relates to a process for producing hydrocarbon from a hydrocarbon containing formation comprising:

- extracting a crude hydrocarbon mixture from a hydrocarbon containing formation;
- mixing the crude hydrocarbon mixture comprising metal naphthenate with an acid in the presence of water, to remove metal naphthenate as hereinbefore described;
- pumping said crude hydrocarbon mixture comprising naphthenic acid to a refinery; and
- preferably pumping said water phase comprising said metal salt into a formation.

Preferred processes of producing hydrocarbon further comprise adding a diluent to the crude hydrocarbon mixture extracted from the formation prior to mixing with the acid. Further preferred processes further comprise upgrading the crude hydrocarbon mixture comprising naphthenic acid prior to pumping to a refinery. Further preferred features of the process for producing hydrocarbon are the same as those set out above for the process of removing metal naphthenate from a crude hydrocarbon mixture.

The present invention also relates to a system for removing metal naphthenate from a crude hydrocarbon mixture. The system comprises:

- a container (e.g. a tank) comprising an acid;
- a line for conveying a crude hydrocarbon mixture to a separator;
- a means for adding the acid to the line conveying a crude hydrocarbon mixture to a separator, wherein said means is fluidly connected to said container comprising acid;
- a first separator for separating a crude hydrocarbon mixture comprising naphthenic acid and a water phase comprising a metal salt, wherein the separator has an inlet for crude hydrocarbon mixture, optionally has an inlet for water, an outlet for crude hydrocarbon mixture comprising naphthenic acid and an outlet for a water phase comprising a metal salt; and
- preferably a line for conveying said water phase comprising a metal salt into a formation.

In a preferred system of the present invention the line for conveying a crude hydrocarbon mixture is fluidly connected to a well arrangement in a formation. In a further preferred system of the present invention the means for adding the aqueous acid is an injector. In a further preferred system of the present invention the line for conveying a crude hydrocarbon mixture is a production pipeline. In particularly preferred systems of the invention the line for conveying a crude hydrocarbon mixture comprises a static mixer, preferably in between the acid injection point and the first separator. In preferred systems of the invention the first separator is a bulk separator.

In some preferred systems of the invention the outlet for crude hydrocarbon mixture comprising naphthenic acid of the separator is fluidly connected to a treater. In other preferred systems the outlet for crude hydrocarbon mixture comprising naphthenic acid of the separator is fluidly connected to a second separator. In this latter case, the system preferably comprises a second means for adding the acid in between the first separator and the second separator. The second means for adding acid is preferably fluidly connected to the container comprising acid. In preferred systems of the invention the second separator is a gravity separator. Preferably the second separator further comprises an inlet for water.

The crude hydrocarbon mixture obtained by the processes hereinbefore described preferably comprises 0.1 to 12 wt % naphthenic acid, more preferably 1 to 10 wt % naphthenic acid and yet more preferably 2.5 to 10 wt % naphthenic acid. More preferably the crude hydrocarbon mixture obtained by the processes hereinbefore described preferably comprise 0 to 100 ppm wt metal naphthenate, still more preferably 1 to 80 ppm wt metal naphthenate and yet more preferably 10 to 50 ppm wt metal naphthenate.

More preferably the crude hydrocarbon mixture obtained by the processes hereinbefore described has an API gravity of less than about 18°. More preferably the API gravity of the crude heavy hydrocarbon mixture is 10 to 18°, more preferably 12 to 18° and still more preferably 16 to 18°. The viscosity of the crude heavy hydrocarbon mixture obtained in the processes hereinbefore described is preferably 250 to 10,000 cSt at 15° C., more preferably 400 to 8000 cSt at 15° C. and still more preferably 500 to 5000 cSt at 15° C.

DETAILED DESCRIPTION OF THE FIGURES

Figure 1:
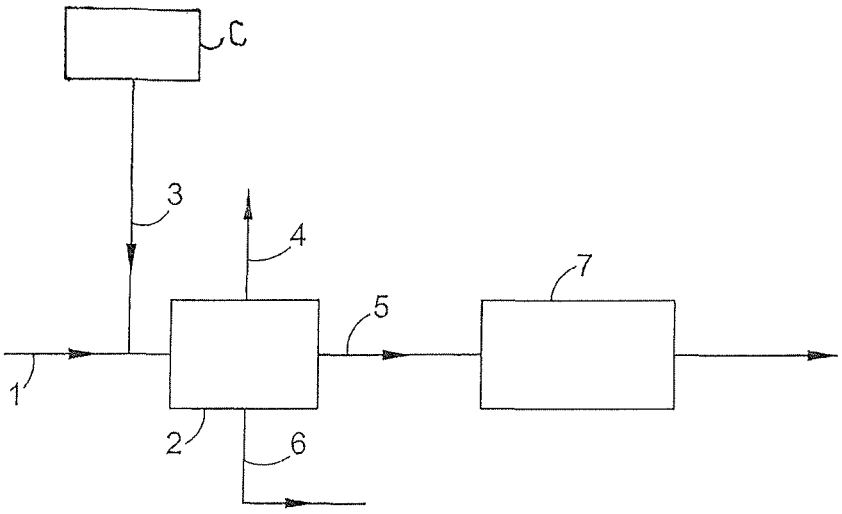
FIG. 1 is a schematic of a preferred process and system of the present invention.

Referring to FIG. 1, a crude hydrocarbon mixture comprising metal naphthenate such as calcium naphthenate is extracted from a formation. The crude hydrocarbon mixture also comprises water. The crude hydrocarbon mixture extracted from the formation typically has a calcium naphthenate content of 400-1000 ppm wt. Its API is typically around 18°.

The crude hydrocarbon mixture is pumped via line 1 to bulk separator 2. An acid in a container C is added via line 3 into the crude hydrocarbon mixture during its transportation to the bulk separator. Due to the fact that the crude hydrocarbon mixture is flowing at a high velocity in the line 3, the acid forms into water droplets. The formation of droplets means that a high level of contact is achieved between the metal naphthenate and the acid even though they are present in different phases, i.e. hydrocarbon and water respectively.

The acid reacts with the metal naphthenate to produce naphthenic acid and metal salt, e.g. $Ca^{2+}$. The metal salt partitions into the water phase whereas the naphthenic acid remains in the crude hydrocarbon mixture. In the separator 2 any gas is removed via line 4 and the hydrocarbon and water phases are allowed to separate. The separation process is enhanced by the removal of metal naphthenate from the crude hydrocarbon mixture. Once separation is completed, the crude hydrocarbon mixture comprising naphthenic acid is transported via line 5 to a treater unit 7. In the treater unit 7 the crude hydrocarbon mixture comprising naphthenic acid is upgraded prior to pumping to a refinery. The water phase comprising metal salt such as $Ca^{2+}$ is removed from the separator via line 6 and is pumped into a hydrocarbon-depleted formation in the vicinity of the well site.

The crude hydrocarbon mixture obtained from the separator 2 typically has a calcium naphthenate content of 0-100 ppm wt and a naphthenic acid content of 0.1 to 12 wt %. Its API is typically around 18°. After upgrading, the crude hydrocarbon mixture typically has a calcium naphthenate content of 0-100 ppm wt and a naphthenic acid content of 0.1 to 12 wt %. Its API is typically around 20°.

Figure 2:
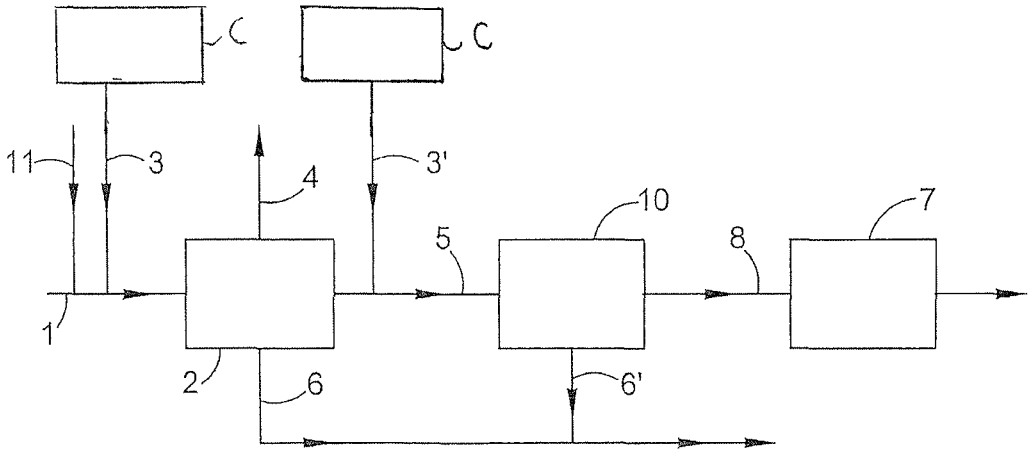
FIG. 2 is a schematic of another preferred process and system of the present invention.

Referring to FIG. 2, the process and system are identical in many ways to that shown in FIG. 1 and thus identical reference numerals are used. In the process shown in FIG. 2, however, a diluent is added to the crude hydrocarbon mixture via line 11 during its transportation to separator 2.

Additionally the crude hydrocarbon mixture comprising naphthenic acid is transported via line 5 to a second separator 10. Further acid in a container C' is added via line 3' to the crude hydrocarbon mixture during its transportation to the second separator 10. As described above in relation to FIG. 1, droplets of aqueous acid are formed and provide a high surface area for contact with metal naphthenate present in the crude hydrocarbon mixture. Optionally further water is added via line 9 into the second separator 10 to improve the separation process. Once separation is completed, the crude hydrocarbon mixture comprising naphthenic acid is transported via line 8 to a treater unit 7 and the water phase comprising metal salt such as $Ca^{2+}$ is removed from the separator via line 6' and is pumped into a hydrocarbon-depleted formation in the vicinity of the well site.

The crude hydrocarbon mixture obtained from the separator 10 typically has a calcium naphthenate content of 0-100 ppm wt and a naphthenic acid content of 0.1 to 12 wt %. Its API is typically around 18°. After upgrading, the crude hydrocarbon mixture typically has a calcium naphthenate content of 0-100 ppm wt and a naphthenic acid content of 0.1 to 12 wt %. Its API is typically around 20°.

The advantages of the present invention include:

- Avoids the expensive process of removing metal naphthenates in the refinery
- Improves the bulk separation process
- Improves any subsequent separation process
- Metal salts removed in the water phase may ultimately be pumped back into the hydrocarbon formation for pressure maintenance
- Installation at wellsite

EXAMPLES

Example 1—Bench Scale Bottle Test of Calcium Removal by Acetic Acid

A series of bottle experiments were carried out wherein acetic acid was added to a mixture of Bressay crude oil with xylene (50/50 vol %) mixed with synthetic formation water with 16940 ppm Na (as NaCl) and 1719 ppm Ca (as $CaCl_2$). After mixing and separation, the amount of Ca remaining in the oil phase was determined by ICP.

Figure 3:
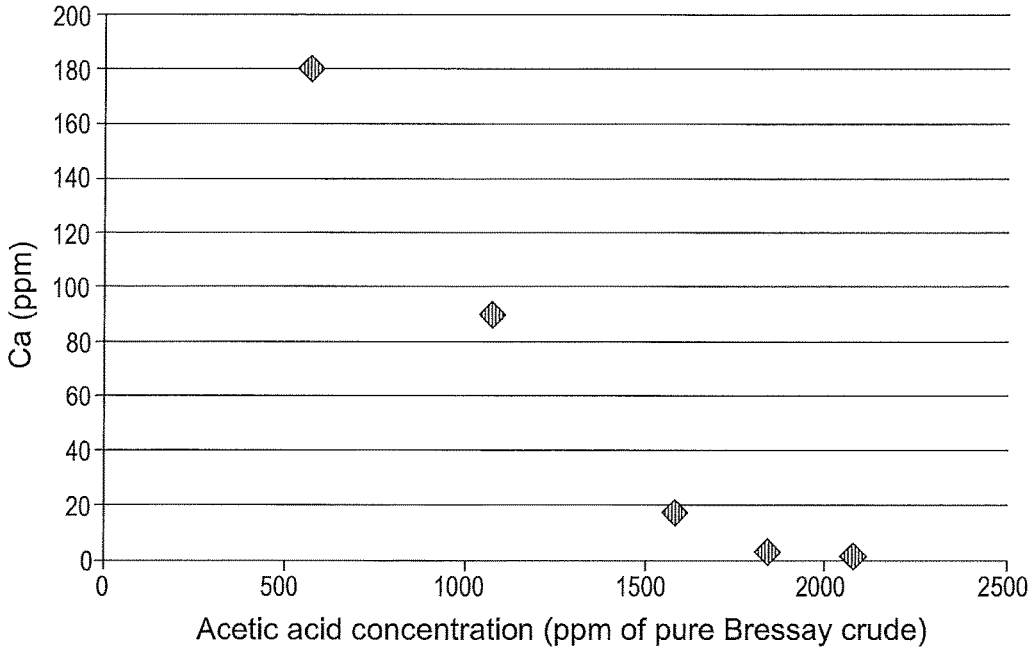
FIG. 3 is a plot of Ca (ppm) in the hydrocarbon phase versus acetic acid concentration in a bottle experiment.

The results are shown in FIG. 3 wherein the Y axis is the amount of Ca present in the oil phase after separation and the X axis is the amount of acetic acid added. The results show that there was less Ca present in the oil phase when higher amounts of acetic acid were added.

Example 2—Bench Scale Bottle Test of Calcium Removal and Naphthenate Formation at Different pH Levels A series of bottle experiments were carried out wherein acetic acid was added to a mixture of Bressay crude oil with xylene (50/50 vol %) mixed with synthetic formation water with 16940 ppm Na (as NaCl) and 1719 ppm Ca (as $CaCl_2$). The mixture was buffered to the desired pH-level by adding MOPS-buffer. After mixing the pH level of the water phase was measured and after separation the amount of Ca remaining in the oil phase was determined by ICP.

Figure 4:
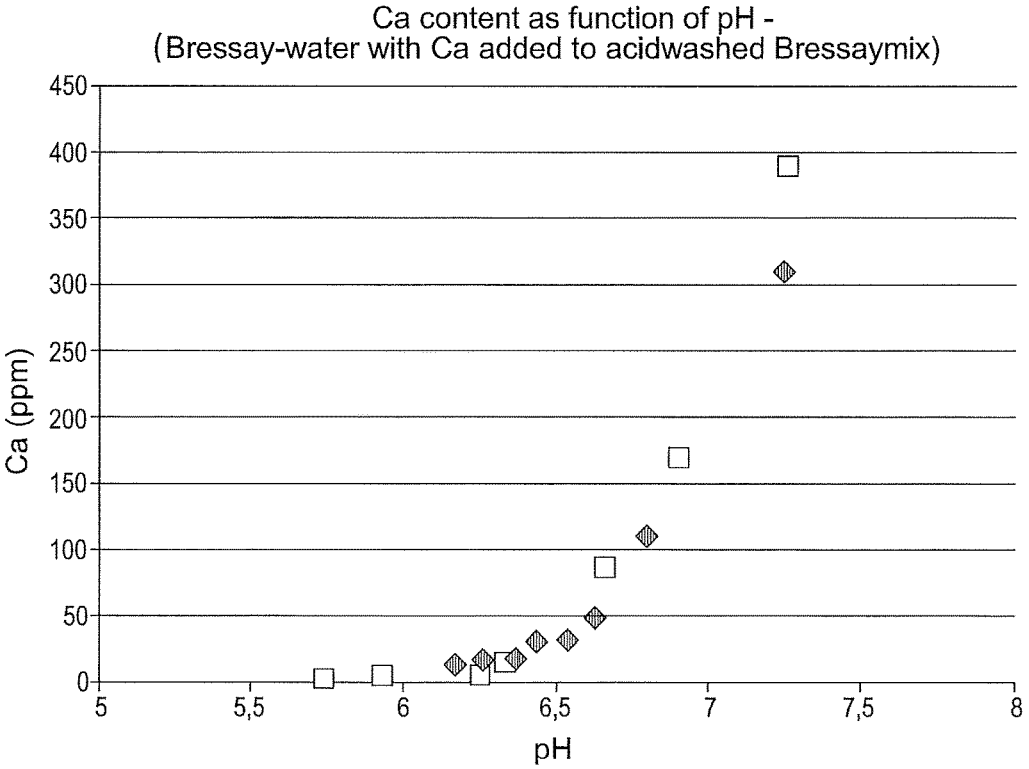
FIG. 4 is a plot of Ca (ppm) in the hydrocarbon phase versus pH in a bottle experiment.

The results are shown in FIG. 4 wherein the Y axis is the amount of Ca present in the oil phase after separation and the X axis is pH. The results show that if a pH of 6.3 or lower is achieved that Ca removal from the oil phase occurs. (The red and blue symbols represent two independent experiments.)

Example 3—Continuous Flow Experiment

Bressay/Åsgard crude (85/15 vol %) was mixed with synthetic formation water, with 16940 ppm Na (as NaCl) and 1719 ppm Ca (as $CaCl_2$). The water cut was 20-25 vol %.

Acetic acid was then added continuously in a stoichiometric amount according to the equilibrium equation, i.e. an amount equal to 1.0 on the X-axis. A static mixer present in the line after the acid injection point ensured mixing of the phases. After a fixed amount of time of 20 minutes, the phases were separated and the amount of Ca present in the oil phase determined by ICP.

Figure 5:
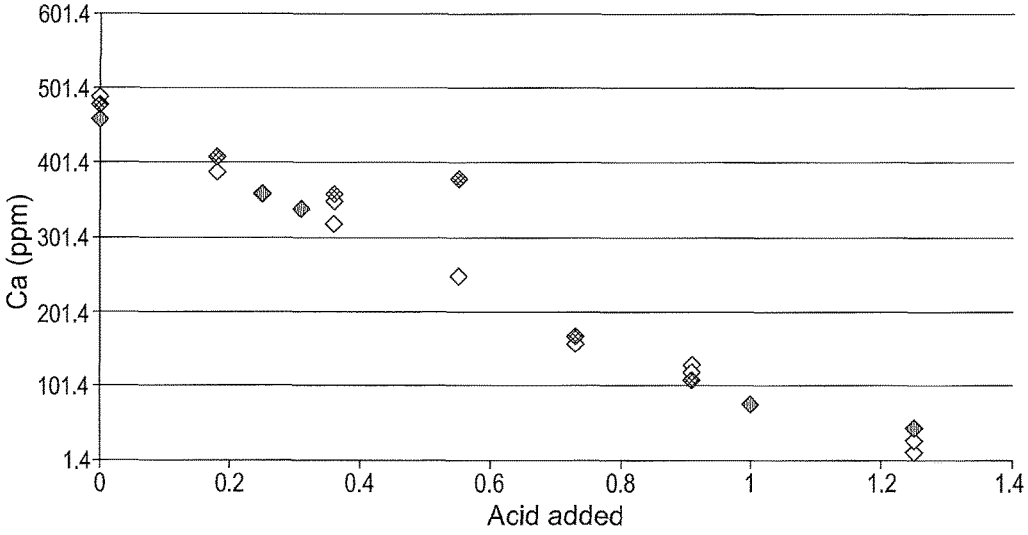
FIG. 5 is a plot of Ca (ppm) in the hydrocarbon phase versus stoichiometric amount of acetic acid added.

The results are shown in FIG. 5 wherein the Y axis is the amount of Ca present in the oil phase after separation and the X axis is the stoichiometric amount of acid added. It can be seen from FIG. 5 that about 1.2 stoichiometric equivalents of acid are required to remove all of the calcium. (Three independent experiments; grey, yellow and red were carried out at 0° C., 40° C. and 70° C. respectively).

The invention claimed is:

1. A process for removing metal naphthenate from a crude hydrocarbon mixture, comprising:

mixing said crude hydrocarbon mixture comprising metal naphthenate with an acid in the presence of water, wherein said acid converts said metal naphthenate to naphthenic acid and metal salt;

allowing said metal salt to partition into a water phase; and separating said crude hydrocarbon mixture comprising naphthenic acid and said water phase comprising said metal salt.

2. The process as claimed in claim 1, wherein said crude hydrocarbon mixture initially comprises at least 40 ppm wt of said metal naphthenate.

3. The process as claimed in claim 1, further comprising adding diluent to said crude hydrocarbon mixture, prior to mixing said crude hydrocarbon mixture with said acid.

4. The process as claimed in claim 1, wherein said acid has a pKa of less than 7.

5. The process as claimed in claim 1, wherein said acid is an inorganic acid.

6. The process as claimed in claim 1, wherein said acid is an organic acid.

7. The process as claimed in claim 1, wherein said mixing is achieved by injecting said acid into a line conveying said crude hydrocarbon mixture.

8. The process as claimed in claim 1, wherein said mixing creates water droplets comprising said acid.

9. The process as claimed in claim 1, wherein said acid is added to a crude hydrocarbon mixture extracted from a subterranean formation.

10. The process as claimed in claim 1, wherein said crude hydrocarbon mixture comprises at least 95% by volume of hydrocarbon.

11. The process as claimed in claim 1, which is carried out at a wellsite.

12. The process as claimed in claim 1, wherein said crude hydrocarbon mixture obtained after separation comprises less than 100 ppm wt metal ion as metal naphthenate and/or 0.1 to 12 wt % naphthenic acid.

13. The process as claimed in claim 1, further comprising treating said crude hydrocarbon mixture comprising naphthenic acid to reduce its API.

14. The process as claimed in claim 1, further comprising pumping said crude hydrocarbon mixture comprising naphthenic acid to a refinery.

15. A process for producing hydrocarbon from a hydrocarbon containing formation comprising:

extracting a crude hydrocarbon mixture from a hydrocarbon containing formation;

mixing said crude hydrocarbon mixture comprising metal naphthenate with an acid in the presence of water, wherein said acid converts said metal naphthenate to naphthenic acid and metal salt;

allowing said metal salt to partition into a water phase;

separating said crude hydrocarbon mixture comprising naphthenic acid and said water phase comprising said metal salt; and pumping said crude hydrocarbon mixture comprising naphthenic acid to a refinery.

16. The process as claimed in claim 15, further comprising adding a diluent to said crude hydrocarbon mixture extracted from said formation prior to mixing with said acid.

17. The process as claimed in claim 15, further comprising upgrading said crude hydrocarbon mixture comprising naphthenic acid prior to pumping to a refinery.

18. A system for removing metal naphthenate from a crude hydrocarbon mixture comprising:

a container comprising an acid;

a line for conveying a crude hydrocarbon mixture to a first separator;

a means for adding an acid to said line conveying a crude hydrocarbon mixture to said first separator, wherein said means is fluidly connected to said container comprising acid; and said first separator for separating the crude hydrocarbon mixture comprising naphthenic acid and a water phase comprising a metal salt, wherein said first separator has an inlet for crude hydrocarbon mixture, an outlet for crude hydrocarbon mixture comprising naphthenic acid and an outlet for the water phase comprising the metal salt.

19. The system as claimed in claim 18, wherein said outlet for crude hydrocarbon mixture comprising naphthenic acid of said first separator is fluidly connected to a treater.

20. The system as claimed in claim 18, wherein said first separator is a bulk separator.

21. The system as claimed in claim 18, wherein said outlet for crude hydrocarbon mixture comprising naphthenic acid of said first separator is fluidly connected to a second separator.

22. The system as claimed in claim 21, wherein said second separator is a gravity separator.

* * * * *